US006350155B1

(12) United States Patent
Müllinger-Bausch et al.

(10) Patent No.: US 6,350,155 B1
(45) Date of Patent: Feb. 26, 2002

(54) PLUG CONNECTOR

(75) Inventors: Christopf Müllinger-Bausch, Titisee-Neustadt; Frank Röse, Donaueschingen; Roland Baumgaertner, Wutach 1, all of (DE)

(73) Assignee: IMS Connector Systems GmbH, Loffingen (DE)

( * ) Notice: Subject to any disclaimer, the term of this patent is extended or adjusted under 35 U.S.C. 154(b) by 0 days.

(21) Appl. No.: 09/528,755

(22) Filed: Mar. 17, 2000

(30) Foreign Application Priority Data

Mar. 17, 1999 (DE) ..... 199 12 000

(51) Int. Cl.[7] ..... H01R 24/00

(52) U.S. Cl. ..... 439/675; 439/31; 439/30; 439/700

(58) Field of Search ..... 439/675, 18, 20, 439/21, 22, 27, 63, 700, 578, 31–32, 209; 379/433

(56) References Cited

U.S. PATENT DOCUMENTS

| | | | | | |
|---|---|---|---|---|---|
| 4,326,769 | A | * | 4/1982 | Dorsey et al. | 439/21 |
| 4,846,719 | A | * | 7/1989 | Iwashita | 439/63 |
| 5,934,911 | A | * | 8/1999 | Stout et al. | 439/21 |
| 6,115,620 | A | * | 9/2000 | Colonna et al. | 379/433 |

FOREIGN PATENT DOCUMENTS

| | | |
|---|---|---|
| DE | 1 217 475 | 5/1966 |
| DE | 2 205 301 | 8/1973 |
| DE | 28 15 330 A1 | 10/1979 |
| DE | 31 15 864 A1 | 1/1982 |
| DE | 36 24 474 C2 | 6/1994 |
| DE | 44 32 884 C2 | 10/1996 |
| DE | 195 20 947 A1 | 12/1996 |
| DE | 196 09 571 A1 | 5/1997 |
| DE | 196 18 113 A1 | 11/1999 |
| EP | 0 836 308 A1 | 4/1998 |
| EP | 0 927 923 A1 | 7/1999 |
| WO | WO 95/08204 | 3/1995 |
| WO | WO 98/39942 | 9/1998 |

* cited by examiner

*Primary Examiner*—Paula Bradley
*Assistant Examiner*—Felix D. Figueroa
(74) *Attorney, Agent, or Firm*—Samuels, Gauthier & Stevens, LLP

(57) ABSTRACT

A plug connector with a hollow, cylindrical, metallic housing (1), within which is centrically disposed an inside contact pin (8, 9, 10) extending at least approximately over the entire axial length of the housing (1). In order to make contact with the reciprocal plug connector, the inside contact pin (8, 9, 10) is accessible at a first front side of the housing (1). The first front side is open toward the plug side of the plug connector, such that a latch interlock (6, 7) and a contact basket (5), which extends out of the open front side of the housing (1) and which is rotatably mounted about the longitudinal axis of the housing (1), are disposed co-axially with the inside contact pin (8, 9, 10). The contact basket (5) makes permanent electrical contact with the metallic housing.

11 Claims, 4 Drawing Sheets

PLUG CONNECTOR

BACKGROUND OF THE INVENTION

The present invention relates to connectors, and in particular to a plug connector.

There is a need for a plug connector tat provides reliable contact even if the reciprocal plug connector is turned about the axis of the plug connector housing. Such twistable plug connectors are needed, for example, in mobile telephones in which the plug connector in the rotary hinge between the cover flap of the mobile telephone and the mobile telephone housing must make a contact tat can be disconnected.

SUMMARY OF THE INVENTION

Briefly, according to an aspect of the present invention, a plug connector comprises a hollow cylindrical metallic housing, within which is centrically disposed an inside contact pin extending at least approximately over the axial length of the housing. The inside contact pin so as to make contact with a reciprocal plug connector, is accessible at a first front side of the housing. The first front side is open toward the plug side of the plug connector, wherein in that a latch interlock and a contact basket, which extends out of the open front side of the housing and which is rotatably mounted about the longitudinal axis of the housing are disposed coaxially with the inside contact pin, the contact basket making permanent electrical contact with the metallic housing.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
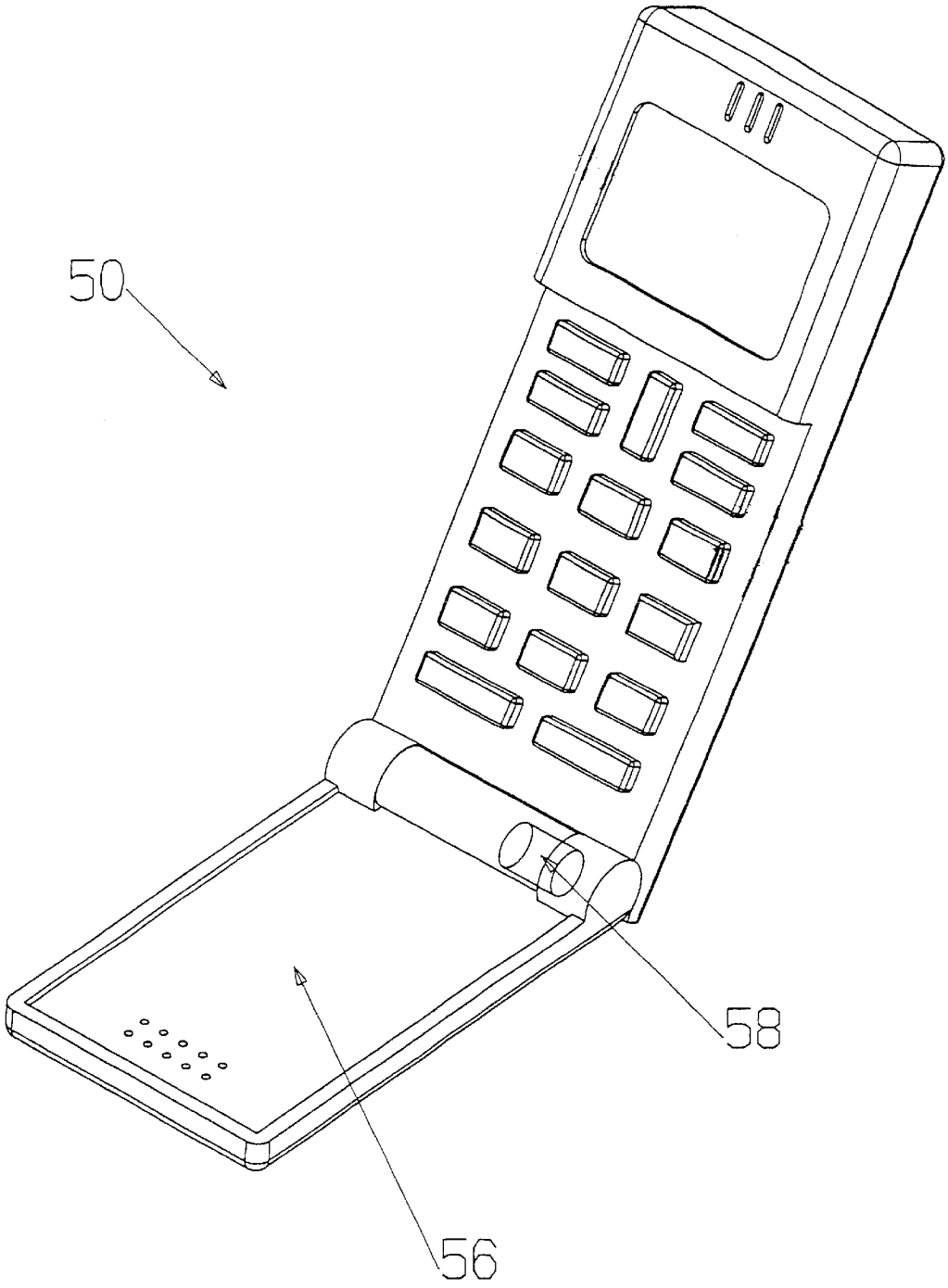
FIG. 1 illustrates a mobile telephone with its cover flipped open comprising a plug connector 58 situated at its hinge.
Figure 2:
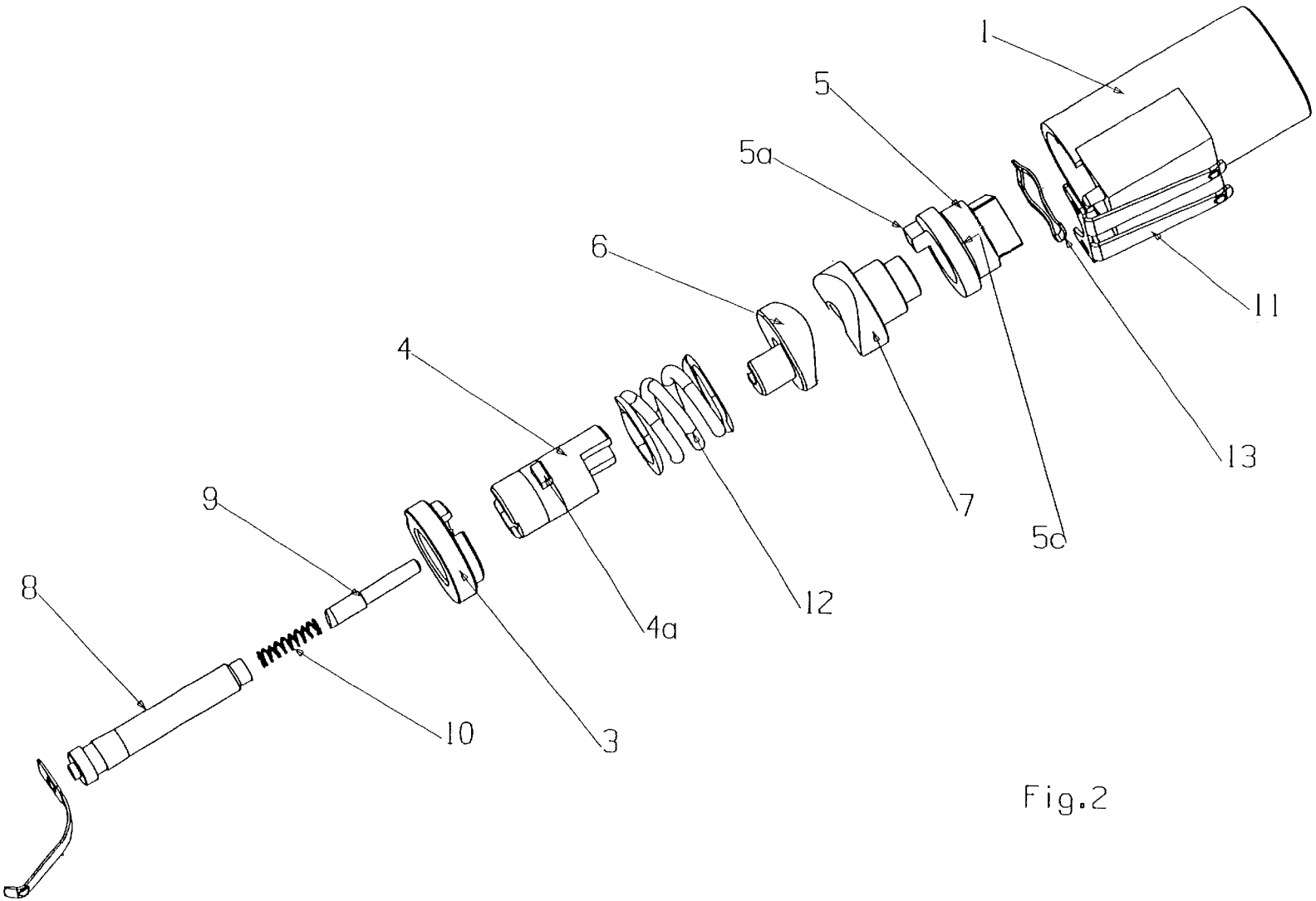
FIG. 2 illustrates an exploded view of the inventive plug connector in perspective.
Figure 3:
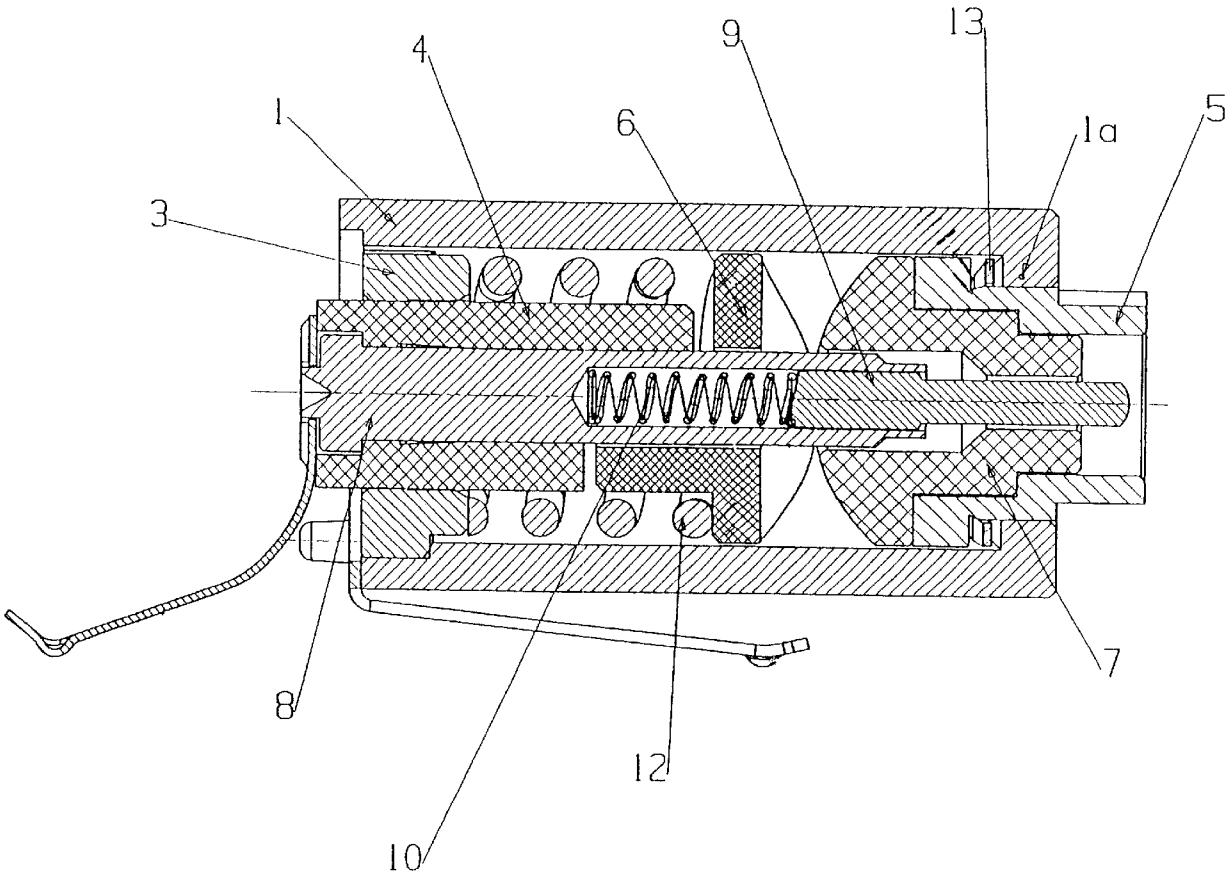
FIG. 3 illustrates a longitudinal section of the completely mounted plug connector of FIG. 2.
Figure 4:
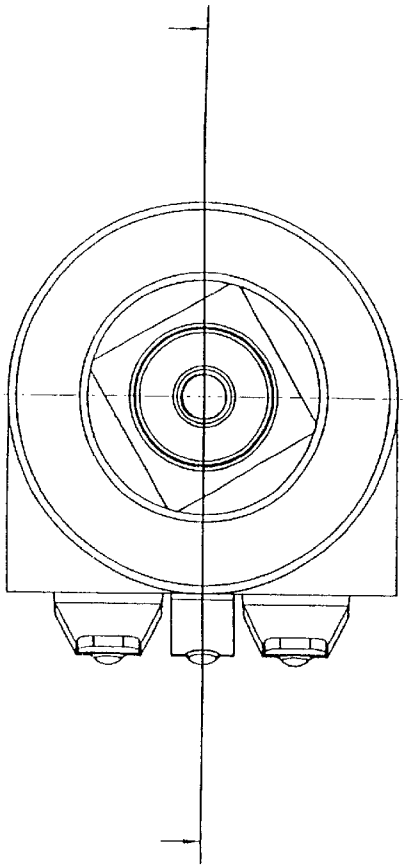
FIG. 4 illustrates a top view from the plug side of the plug connector of FIG. 3.
Figure 5C:
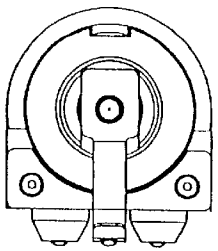
FIGS. 5*a*–5*e* (collectively FIG. 5) illustrate various sectional and perspective views of the inventive plug connector.
Figure 5B:
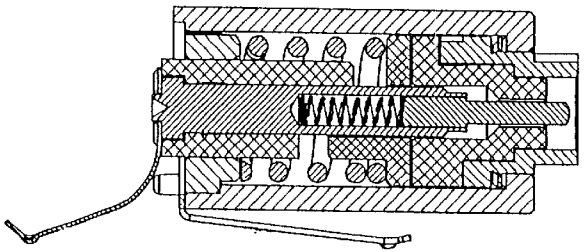
Figure 5E:
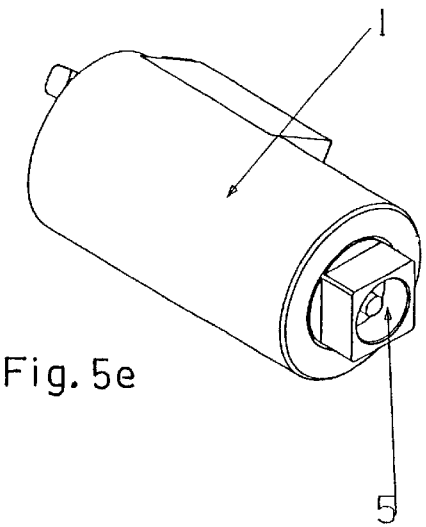
Figure 5A:
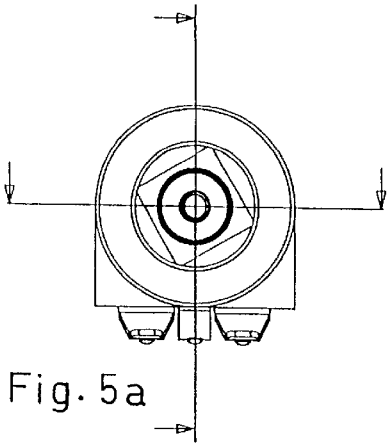
Figure 5D:
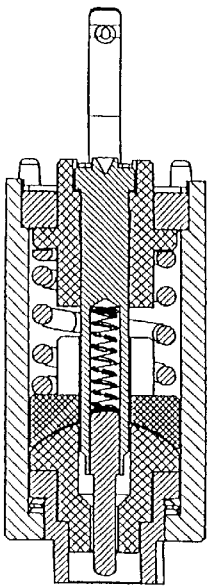

FIG. 1 illustrates a mobile telephone 50 with its cover 56 flipped open comprising a plug connector 58 situated at its hinge.

Referring to FIGS. 2–5, a shaft plate 13 is pushed into a housing 1 from the rear. The "matching/reciprocal geometry" of the contact plate 13 is incorporated into the inner front side of the housing. In this way, the contact plate 13 is held fast in the housing against rotation or twisting.

A contact basket 5 is pushed into the housing 1 from the rear. This basket 5 can later be turned within the housing 1. Significantly, however, the basket maintains electrical contact with the housing 1 through a sliding contact with the contact plate 13. The contact basket 5 makes a positive connection with a latch housing 7.

The latch housing 7 has a specially formed V-geometry that preferably "latches" at 180° and 360°. This function is directly connected with the position of the "handy front flap."

A second latch housing 6 comprises the reciprocal contour of the above-mentioned V-geometry of the latch housing 7. A defined angular displacement between the V-geometry and the hemi-shell can influence the pre-tension of the handy front flap. This means that the front flap also remains securely closed under the influence of a pre-tension force.

The latch housings 6, 7 are preferably made of plastic with especially good sliding properties and form a latch interlock or a latch hinge.

The latch housing 6 has a hemi-shell opposite the V-geometry, positively engaging an insulation part 4. In this way, these two parts are also uniquely determined in their position.

Noses 4*a* on the insulating part 4 also provide a positive connection to a locking cover 3. The locking cover 3 also makes a positive connection with the housing 1 and is pressed and positioned into the housing from the rear. All the other interior parts can be mounted with a light sliding seat.

The mutual position of the parts makes it possible to achieve the exact angular position of the square 5*a* of the contact basket with respect to the housing 1 in a mounting-friendly and secure way.

A spring 12 exerts pressure against the V-geometry of the latch housings 6, 7. To open or close the flap, the spring force must be overcome (see angular displacement to create the pre-tension).

Contact piston 9 is likewise partly pushed into a contact pin housing 8, and is fixed with a flange. The flange is just thick enough so that the piston 9 can move axially without shifting.

A signal spring 10 is fastened to the end of the contact housing 8 (e.g., by riveting or shaking). The ground spring 12 is also fastened to the housing (e.g., by riveting or shaking).

When the two springs 10, 12 are installed later on, they create a solderless connection to the PCB.

The present invention has several unique features. A latch function and the transport of a high frequency (HF) signal are combined in one component. In addition, despite the turning motion the contact plate maintains permanent electrical contact with the housing 2 and, via the ground spring, to the PCB. Another feature of the inventive plug connector is that the spring-mounted inside pin can intercept axial tolerances and likewise maintains permanent electrical contact during rotational motion. Also, the geometry of the interior parts produces several positive connections that guarantee a unique angular position of the square and prevent faulty and/or inaccurate mounting. The creation of a pre-tension (locking force) depends on the design (angular displacement of the V-geometry relative to the hemi-shell) of the latch housing 6. Thus it is uniquely and positively locked in and thus guaranteed to be reproducible.

In the above-referenced figures, the contact plate was formed as a shaft plate. However, the contact plate 13 can also be formed as a flat plate. It must only be assured that even while the contact basket 5 is being turned, good electrical contact with the housing 1 of the plug connector is assured through the contact plate 13. One possible embodiment of the housing 1 is its realization as a die cast zinc housing.

If a harder material is used for the housing 1 of the plug connector, the above-mentioned contact plate 13 can be dispensed with entirely. It must only be assured that the protruding collar 5*c* of the contact basket 5 always makes good electrical contact with the inward protruding collar 1*a* of the metallic housing 1 during the turning process, that is when the cover of the mobile telephone is flipped open.

Although the present invention has been shown and described with respect to several preferred embodiments thereof, various changes, omissions and additions to the form and detail thereof, may be made therein, without departing from the spirit and scope of the invention.

What is claimed is:

1. A plug connector for use in a wireless telephone hinge assembly to couple electrical signal energy through the hinge assembly, said plug connector comprising:

a hollow metallic housing having an axial length, within which is concentrically disposed an inside contact pin extending over the axial length of the housing, and said inside contact pin in order to make contact with a reciprocal plug connector is accessible at a front side of the housing, the front side being open toward the plug side of the plug connector, wherein a latch interlock and a contact basket, which extends out of the open front side of the housing and which is rotatably mounted about the longitudinal axis of the housing, are disposed coaxially with the inside contact pin, the contact basket making permanent electrical contact with the metallic housing via a contact plate that is configured and arranged to provide a longitudinal sliding electrically conductive contact, which is coaxial with the inside contact pin.

2. The plug connector of claim 1, wherein the latch interlock has a first insulating part rotatably mounted about the longitudinal axis of the housing, and a second insulating part, fixed with respect to the longitudinal axis of the housing, that the two insulating parts are seated on the contact pin and are disposed so that their mutually facing front sides engage one another through the action of the force of a spring, and that the contact basket is connected non-rotatably to the first insulating part.

3. The plug connector of claim 2, wherein the inside contact pin has a contact pin housing with a hollow cylindrical section that faces in the direction toward the plug side of the plug connector, that a contact piston is seated in this section, such that said contact piston is supported via another spring against the floor of the hollow cylindrical section of the contact pin housing.

4. The plug connector of claim 2, wherein the mutually facing front sides of the two insulating parts are formed as plates, and one of the front sides has a V-shaped recess and the other front side has a corresponding mating V-shaped protrusion.

5. The plug connector of claim 4, wherein, the open front side of the housing has a housing annular collar protruding inward;

a contact plate that abuts the circumferential inside wall of this collar; and a contact basket annular collar of the contact basket, which protrudes radially from the longitudinal axis of the housing, presses against this contact plate.

6. The plug connector of claim 5, wherein the contact plate includes a shaft plate.

7. The plug connector of claim 4, wherein the inside contact pin has a contact pin housing with a hollow cylindrical section that faces in the direction toward the plug side of the plug connector, that a contact piston is seated in this section, such that said contact piston is supported via a second spring against the floor of the hollow cylindrical section of the contact pin housing.

8. The plug connector of claim 7, wherein, the open front side of the housing has a housing annular collar protruding inward;

a contact plate abuts the circumferential inside wall of this collar; and a contact basket annular collar of the contact basket, which protrudes radially from the longitudinal axis of the housing, presses against the contact plate.

9. The plug connector of claim 7, wherein a contact plate is disposed in a non-rotational manner within the housing.

10. The plug connector of claim 1, wherein the housing is formed of die cast zinc.

11. A mobile telephone plug connector located at a flap that is connected via a rotary hinge to the housing of the mobile telephone, said mobile telephone plug connector comprising:

a hollow metallic housing having an axial length, within which is centrically disposed an inside contact pin extending at least approximately over the axial length of the housing, and this inside contact pin, so as to make contact with a reciprocal plug connector is accessible at a front side of the housing, the front being open toward the plug side of the plug connector, wherein a latch interlock and a contact basket, which extends out of the open front side of the housing and which is rotatably mounted about the longitudinal axis of the housing, are disposed coaxially with the inside contact pin, the contact basket making permanent electrical contact with the metallic housing via a contact plate that is configured and arranged to provide a longitudinal sliding electrically conductive contact, which is coaxial with the inside contact pin.

* * * * *